United States Patent [19]

Wolf

[11] 3,995,276

[45] Nov. 30, 1976

[54] CUSTOMIZED ANTENNA WITH INSERTABLE ANTENNA ELEMENTS

[76] Inventor: Andrew Wolf, 5111 Biddulph Road, Cleveland, Ohio 44144

[22] Filed: Mar. 21, 1975

[21] Appl. No.: 560,823

[52] U.S. Cl. ..... 343/815; 343/823

[51] Int. Cl.[2] ..... H01Q 21/12

[58] Field of Search ..... 343/823, 846, 908, 915, 343/812, 813, 814, 815, 724

[56] References Cited

UNITED STATES PATENTS

| | | | |
|---|---|---|---|
| 3,261,019 | 7/1966 | Lundy | 343/908 |
| 3,267,479 | 8/1966 | Smith et al. | 343/815 |
| 3,277,492 | 10/1966 | Roebken | 343/823 |
| 3,665,478 | 5/1972 | Dempsey | 343/846 |
| 3,750,185 | 7/1973 | Evans | 343/815 |

*Primary Examiner*—Alfred E. Smith
*Assistant Examiner*—David K. Moore
*Attorney, Agent, or Firm*—Donnelly, Maky, Renner & Otto

[57] ABSTRACT

An antenna primarily for receiving electromagnetic signals and for converting the same to electrical signals for input to a television, FM receiver, or the like, is readily adapted for customizing for maximum efficiency in signal reception at close, normal, and fringe areas relative to the broadcasting antenna. The customized antenna may include elongated generally tubular elements of different sizes, bow tie-shape reflector elements, and/or relatively flat elements, all of which are readily mounted on a support structure that may be attached to an interior or exterior wall, a conventional antenna mast, or the like. Moreover, various ones of the longitudinal elements may be electrically coupled by a conductive harness, and the transmission line leads may be adjustably connected to respective ones of the longitudinal elements. Further, the support structure may include a decorative panel behind which the various signal receiving elements are mounted.

13 Claims, 6 Drawing Figures

CUSTOMIZED ANTENNA WITH INSERTABLE ANTENNA ELEMENTS

BACKGROUND OF THE INVENTION

The present invention is directed to an antenna, and more particularly is directed to an antenna that may be readily customized for maximum signal-reception effectiveness with minimum cost.

Conventional antennas usually have a fixed configuration design for effective reception, respectively, in the immediate or close zone, say within a ten mile radius of the transmitter; the intermediate zone, covering a radius from 10 to 25 miles from the transmitter; or the fringe zone, covering a range of from 25 to 75 miles from the transmitter. The antennas designed for immediate zone reception are usually simple and inexpensive relative to the fringe area antennas, and the intermediate zone or area antennas are of correspondingly intermediate complexity and cost. Moreover, conventional antennas usually have fixed preferred frequency characteristics with maximum reception effectiveness for one or selected signal frequency band or bands of, for example, one or several television channels; but such antennas have a reduced effectiveness for other channels, and consumers are usually unaware of the particular preferred reception channel of a newly purchased antenna until such antenna is installed.

With the trend toward aesthetically pleasing television sets, it is desirable also to enhance the appearance of indoor antennas placed in proximity of the television. In fact, it would be most desirable to fully hide or shield from view the indoor antenna, while providing facility of mounting the antenna in proximity to the television set and efficiency in signal receiving capability.

SUMMARY OF THE INVENTION

The instant invention provides an antenna that is aesthetically pleasing to the taste of the consumer while also being structurally capable of facile modification or customizing enabling the consumer to obtain maximum reception effectiveness with a minimum of cost. Additionally, the particular antenna design in terms of placement of the signal receiving elements thereon, may be modified to maintain such effectiveness as local topography varies, for example, by the construction of a large building, bridge, or the like, in or proximate the signal path from the transmitter to the antenna. Accordingly, the antenna of the present invention principally includes an electrically non-conductive, support structure, a plurality of electrically conductive, electromagnetic signal receiving elements mounted on such support structure in a configuration determined by the user, means for interconnecting respective elements, a decorative panel effectively camouflaging the elements and variable to the taste of the consumer, and various antenna attaching arrangements for wall or mast attachment. By adding or changing elements a close zone antenna may be readily adapted for fringe zone use.

With the foregoing in mind, it is a primary object of the invention to provide an antenna improved in the noted respects.

Another object of the invention is to provide for customizing of an antenna for optimum signal reception and minimum cost.

A further object of the invention is to provide a decorative indoor-type antenna.

An additional object of the invention is to provide for interchangeability of parts in a customized antenna making the same readily adaptable for immediate or close, intermediate, and fringe zone reception.

Still another object of the invention is to facilitate attaching an indoor-outdoor antenna to a support.

These and other objects and advantages of the invention will become apparent as the following description proceeds.

To the accomplishment of the foregoing and related ends the invention, then, comprises the features hereinafter fully described in the specification and particularly pointed out in the claims, the following description and the annexed drawing setting forth in detail a certain illustrative embodiment of the invention, this being indicative, however, of but one of the various ways in which the principles of the invention may be employed.

DESCRIPTION OF THE PREFERRED EMBODIMENT

Figure 1:
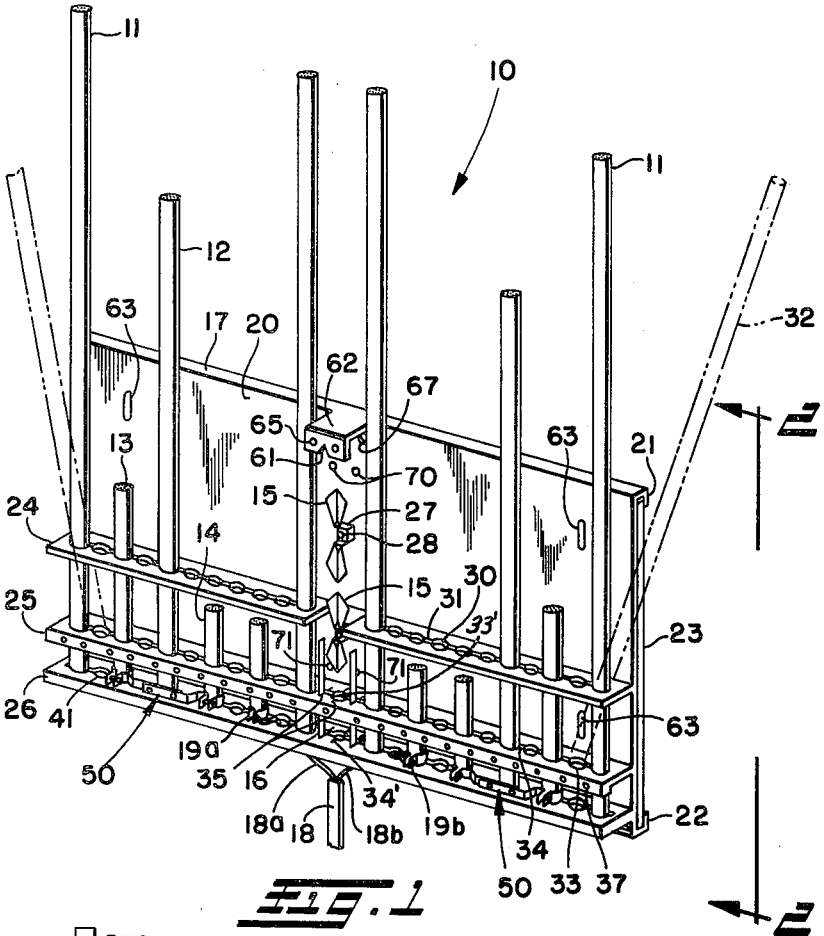
FIG. 1 is an isometric view of the antenna in accordance with the present invention.

Referring now more particularly to the drawing, wherein like reference numerals designate like parts in the several figures, an antenna in accordance with the invention is generally indicated at 10 in FIG. 1. The antenna includes a plurality of electrically conductive electromagnetic signal receiving elements in the form of relatively elongated cylindrical rods of respective lengths and indicated, respectively, at 11, 12, 13, and 14. The elements 11 through 14 as well as bow tie-shaped electrically conductive signal receiving elements 15 and flatshape electrically conductive signal receiving elements 16 are all mounted on an electrically non-conductive support structure 17. The conductors 18*a*, 18*b* of a conventional transmission line 18 are electrically connected to two of the cylindrical elements by respective connectors 19*a*, 19*b*, and the transmission line 18 is in turn coupled to the signal input of a receiver, such as, for example, a television, an FM tuner, or the like.

As described by Donald L. Nelson in his book *Television Antennas*, published by Howard W. Sams and Co., Inc., Indianapolis, Indiana, 1951, an antenna suitable for effective signal reception in an immediate region or zone of a transmitter, say approximately within a 10 mile radius thereof, may be a simple dipole antenna, which may include only a single straight or folded dipole element; however, for effective signal reception in intermediate and fringe zones, more and more elaborate antennas are required, usually including director and reflector elements that appreciably add to the cost of the antenna. Moreover, it is also desirable that the antenna impedance remain linear over a wide band of frequencies for impedance matching with the receiver, and a linear impedance characteristic usually can be obtained by using antenna elements having relatively thick cross section to maintain a low value of "Q" for the antenna, it having been found that a higher "Q" value is obtained with thin elements. Additionally, a low "Q" value is desirable to avoid frequency discrimination that might otherwise cause amplification of one picture frequency more than another in the same channel, which usually has a relatively wide bandwidth of several megacycles.

Accordingly, the elements 11 through 14 may be, for example, of conventional extruded thin wall aluminum tubing, or the like, normally used in conventional antennas; however, in another form those elements may be comprised of tubular pieces of styrofoam, cardboard, or the like, having a diameter on the order of one inch and wrapped with an electrically conductive foil, such as aluminum foil or the like. The bow tie-shape reflectors 15 also may be formed out of foil material, and the flat reflector elements 16 may be formed of three-eighths inch by 4 inch pieces of aluminum or other metal. Preferably the respective lengths of the tubular elements 11 through 14, are, respectively, 24 inches, 18 inches, 8 inches, and 4 inches, although other lengths may be used depending on the frequency or frequencies of the signals to be received by the antenna; the diameter of the tubular elements is not critical except to the extent that very thin elements that exhibit a high "Q" value normally would be undesirable.

The support structure 17 may be formed of plastic, cardboard material, or the like and comprises a relatively flat panel-like surface 20 with a pair of flange lips or edges 21 22, on its front side to receive a decorative panel insert 23, such as a photograph, painting, or the like. On the back side of the panel 20 top, intermediate and bottom support brackets 24, 25, and 26 provide for positioning of the tubular and flat elements on the support structure. A pair of shoulder support blocks 27 provide for mounting of the bow tie reflectors 15 on the support structure using a screw, rivet, or other type of fastener 28.

The top support bracket 24 preferably has a plurality of guide holes 30 located therein, each guide hole having a diameter on the order of the diameter of the tubular elements 11 through 14. The guide holes 30 are connected by a central slot 31 that provides some resilience to the top support bracket to allow the tubular elements to be positioned therein in a fan-like relation, as is shown in phantom, for example, at 32. The top support bracket 24 also may be formed in two parts, as shown, in order to provide a space for location of a bow tie reflector 15 in the manner shown in FIG. 1; however, it is, of course, to be understood that the top support bracket 24 may be continuous in the event it were not desired to provide for such a bow tie.

The intermediate support bracket 25 has a plurality of guide holes 33, which are aligned with the guide holes 30 in the top support bracket 24 and which are similarly connected by a slot 34 to allow for fanning of the tubular elements in the manner described above. A central guide hole 33' is formed in the intermediate support bracket 25, which is also substantially continuous along its length, and a plurality of narrow slots 35 through the intermediate support bracket provide for mounting of the flat elements 16 in the manner shown in FIG. 1. Moreover, a downwardly turned flange 36 provides an added measure of strength to the intermediate support bracket and a plurality of locking holes 37 are fitted with screws 38, only one of which is shown in FIG. 2, or other fastening means, which may be tightened into engagement with respective tubular elements for securing or locking the same in relatively fixed position.

Figure 2:
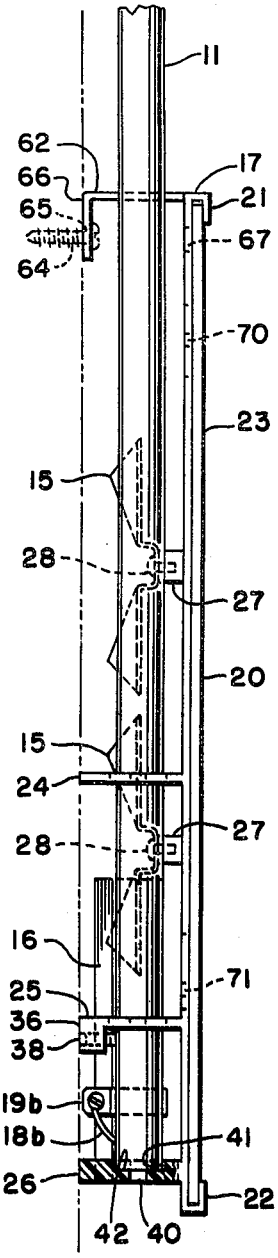
FIG. 2 is an end view on enlarged scale of the antenna of FIG. 1 looking in the direction of the arrows 2—2 thereof.
Figure 5:
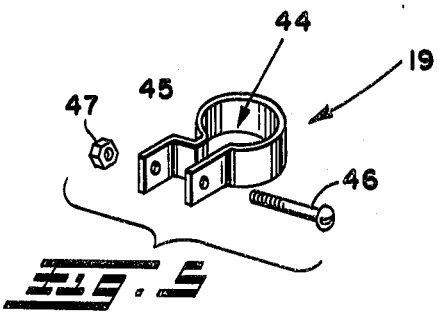
FIG. 5 is an exploded isometric view of a lead attaching bracket for use in the antenna of FIG. 1.

A slot 40, which is most clearly seen in FIG. 2, is formed along the entire extent of the bottom support bracket 26, and a plurality of partial guide holes 41 are also located in the bottom support bracket in alignment with the guide holes 30 and 33 for receipt of the bottom ends of respective tubular elements. The diameter of the partial guide holes 41 is on the order of the diameter of the respective tubular elements, and the bottom solid surface 42 of the partial guide holes provides a bottom resting support for the tubular elements. Partial narrow slots 34' are provided to receive and to support flat elements 16. The leads **18*a*, 18*b* of the transmission line 18 may pass through the slot 40 for attachment to respective tubular elements by the connectors 19*a* and 19*b* that are shown most clearly at 19 in FIG. 5.**

Figure 1A:
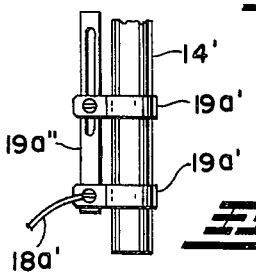
FIG. 1A is a partial elevation view of a modified lead connection arrangement for the antenna of FIG. 1.

Each connector 19 is formed of electrically conductive material, such as aluminum, or the like, and has a cylindrical opening 44 that fits about the outer circumference of a tubular element. An off-set bend 45 in the connector 19 provides for tightening of the connector about a tubular element and also for some spring loading against the action of the tightened screw 46 and nut 47 combination. The respective leads **18*a*, 18*b* are thus electrically connectable to respective tubular elements by wrapping the same about the screw 46 proximate its head and then tightening the nut 47 onto the screw while at the same time securing the connector 19 to one of the tubular elements. Thus, the transmission line leads may be connected to any pair of tubular elements, either proximate their respective points of insertion to the partial guide holes 41 in the bottom support bracket 26 or any place along their respective longitudinal extents to vary the effective wave length of such elements. I have found that the detrimental affects of automobile electronic ignitions and some weather conditions on the reception effectiveness of the antenna may be overcome by the double connector arrangement of FIG. 1A. Such arrangement uses two connectors 19*a*' coupled to a tubular element 14', to a lead 18*a*' and to each other, the latter being effected by an adjustable conductive strap 19*a*''** to allow for adjustment of the connector spacing by the user until optimum signal reception is achieved.

Figure 4:
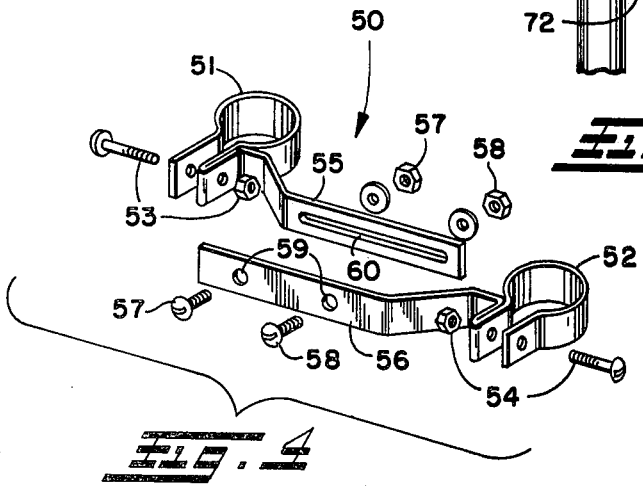
FIG. 4 is an exploded isometric view of an element connecting harness used in the antenna of FIG. 1.

By harnessing two or more adjacent or alternate tubular elements effectively to electrically interconnect the same, I have found that variations in the signal receiving efficiency of the antenna 10 will occur. Accordingly, an expandable electrically conductive harness arrangement for that purpose is most clearly illustrated in FIG. 4. The harness arrangement 50, which is formed of electrically conductive materials, such as aluminum or the like, includes a pair of cylindrical connectors 51, 52 that are easily attached to respective tubular elements and secured thereto by respective screw and nut pairs 53, 54. Moreover, a pair of respective brackets 55, 56, which are to an extent off-set to avoid engagement with an intermediate tubular element, are connectable by one or more additional screw and nut pairs 57, 58 through respective holes 59 and slot 60 in the off-set brackets 55, 56.

Figure 3:
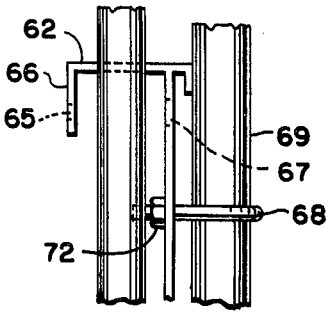
FIG. 3 is a section view of part of the antenna of FIG. 1 showing a U-bolt attaching connection to a mast.

A V-shape notch 61 in a hanger 62 provides for facile attachment of the antenna 10 to a conventional picture hanger or simply a nail or stud partially protruding from a wall. The antenna 10 alternatively may be attached to a wall or other support by screws or the like that pass through the slots 63 in the planar panel 20 of the support structure 17, and in accordance with this form of attachment, the back end surfaces of the top, intermediate and bottom support brackets 24, 25, and 26 parry against the wall to avoid distortion of the tubular elements. A further method for attaching the antenna 10 to a wall or a wood stud, for example, uses a pair of screws 64 through holes 65 in the downwardly turned flange 66 of the hanger 62, and access for driving the screws may be provided through enlarged openings 67 in the planar surface 20. Still a further attaching arrangement for the antenna 10 is illustrated in FIG. 3, wherein a pair of U-bolts 68, only one of which is shown in FIG. 3, secure the antenna 10 to a conventional antenna mast 69. The U-bolts pass through the panel 20 of the support structure 17 in respective holes 70, 71 and are tightened against the panel and mast by nuts 72. Each of the mentioned attaching methods for the antenna 10 provides for mounting the respective signal receiving elements in a vertical plane. It is, of course, to be understood that simply by using an angular off-set support to which the antenna 10 may be attached the signal-receiving elements may be located in a generally horizontal plane, and the antenna may be used in an indoor or an outdoor environment.

In using the antenna 10 to receive electromagnetic signals in close zones relative to the transmitter, a minimum number of tubular elements would be necessary for suitable reception. For example, a pair of 18 inch or 24 inch tubular elements may be placed in the support structure 17 generally in the manner shown in FIG. 1, and the spacing between those elements as well as the location of the connectors 43 and leads **18*a*, 18*b***, respectively, thereon, may be varied until it is determined that optimum signal reception is achieved for the several channels broadcast in that vicinity. Such an antenna obviously required a minimum number of parts and, accordingly, is of minimum cost. Additional tubular elements, bow tie-shaped reflectors and/or flat elements may be separately purchased and added to the previously described simple antenna structure for effective signal reception in an intermediate zone; and a correspondingly more comprehensive antenna may be constructed by the user for effective reception in a fringe zone.

The antenna, therefore, is readily adapted for customizing by the user for optimum signal receiving effectiveness at the user's particular location with respect to the transmitter. The user simply may test several antenna configurations, i.e. locations and combinations of tubular, bow tie, and/or flat elements until a satisfactory picture or sound is received at the television set, FM receiver, or the like. During such trial harnessing arrangements or connections may be varied, and the connections of the transmission line leads **18*a*, 18*b* also may be varied. Additionally, several of the tubular elements may be placed in a fan-like configuration in the manner shown, for example, at 32 in FIG. 1.**

It has been found that it is usually desirable to connect the transmission leads to tubular elements located relatively proximate the center of the antenna 10, as opposed to the outer peripheral tubular elements, in the manner shown, for example, in FIG. 1. It has also been found that the bow tie-shaped reflectors 15 and the flat elements 16 enhance both UHF and VHF signal reception.

The particular configuration of elements as shown in FIG. 1 has been tested, and it has been found quite suitable for use in close to intermediate zone reception. A preferred form of antenna configuration that has been tested for use in intermediate to fringe zone locations had the following configurations: For the tubular elements shown at the left half of the antenna 10 of FIG. 1, reading from left to right, were substituted, respectively, approximately one inch diameter tubular elements formed of "Styrofoam" tubes wrapped with metal foil and of 18 inches, 8 inches, 18 inches, 4 inches, 8 inches, 8 inches in length. The two 18 inch elements were electrically harnessed; the two adjacent 8 inch elements were electrically harnessed, and the third 8 inch and the 4 inch tubular elements were electrically harnessed. One of the transmission leads was connected proximate the bottom of the 4 inch tubular element. The tubular elements, harnessing, and lead connection on the right half of the antenna was the mirror image of or symmetric with the left half, and three flat three-eighths inch by four inch reflector elements were located respectively in the slots 34, 34' in the intermediate and bottom support brackets 25 and 26. Also, a bow tie reflector element was located directly above the central flat element. The support structure 17 was formed of generally rectangular electrically non-conductive material having a width of approximately 25 inches and height of approximately 19 inches in order to ensure that the top edge of each of the tubular elements was fully hidden by the panel. Also, the width of each of the support brackets was on the order of one and three-fourths inches and the guide holes in the same were on the order of one inch diameter and were located approximately on slightly more than one inch centers.

It should now be understood that the present invention provides for variations or customizing in an antenna structure to adapt the same for optimum reception of electromagnetic signals. The disclosed antenna may be used indoors or outdoors, and in the former case provides for hiding the antenna elements from view in order to present an aesthetically pleasing appearance.

The embodiments of the invention in which an exclusive property or privilege is claimed are defined as follows:

1. A center fed dipole antenna, comprising a plurality of elongate, generally tubular electrically conductive electromagnetic signal receiving elements forming the responsive arms of such dipole, electrically non-conductive support means for supporting said elements generally symmetrical about an axis of the antenna in respective, spaced-apart, relatively fixed, substantially co-planar positions and thus forming a dipole array, said support means including a generally linearly extending bracket with holder means generally bisected by such axis to form two arms of such array for interchangeably receiving and holding respective elements in such spaced-apart positions extending in a direction generally parallel to such axis, whereby said elements are readily selectively adjustable to different locations in said support means to adjust the signal receiving effectiveness of the antenna, and means for electrically connecting at least two of said elements to a receiver.

2. An antenna as set forth in claim 1, said tubular elements being of different lengths.

3. An antenna as set forth in claim 2, each of said tubular elements having a sufficient diameter to be of relatively low "Q" value.

4. An antenna as set forth in claim 2, further comprising bow tie-shape reflector elements electrically isolated from said tubular elements, and means for mounting said bow tie-shape reflector elements on said support means between at least two of said tubular elements.

5. An antenna as set forth in claim 2, further comprising flat reflector elements electrically isolated from said tubular elements, and means for mounting said flat reflector elements on said support means between at least two of said tubular elements.

6. An antenna as set forth in claim 2, said support means further comprising a second generally linearly extending mounting bracket positioned in parallel spaced-apart location from said first-mentioned bracket, each of said brackets having a plurality of respectively aligned guide holes therethrough for receiving respective tubular elements.

7. An antenna as set forth in claim 6, at least one of said brackets including means for securing said tubular elements in relatively fixed position.

8. An antenna as set forth in claim 6, said mounting bracket comprising a base support bracket having holes partially through the same for alignment and support of said tubular elements, said base support bracket further including a longitudinal slot permitting access to said tubular elements for electrical connection of transmission line leads.

9. An antenna as set forth in claim 6, further comprising bow tie-shape reflector elements electrically isolated from said tubular elements, and means for mounting said bow tie-shape reflector elements on said support means between at least two of said tubular elements, and said support means including a substantially planar surface to which said brackets are attached, and further comprising mounting shoulders for attachment of bow tie-shape reflector elements.

10. An antenna as set forth in claim 2, the lengths of said tubular elements being in the range of from about 4 inches to 24 inches.

11. An antenna as set forth in claim 1, further comprising means for attaching said support means to an external support structure.

12. An antenna as set forth in claim 1, further comprising harness means for electrically connecting a plurality of said signal receiving tubular elements.

13. An antenna as set forth in claim 12, said harness means being expandable for connection of a plurality of signal receiving tubular elements located at different distances from one another.

* * * * *